US007772526B2

(12) United States Patent
Chuong

(10) Patent No.: US 7,772,526 B2
(45) Date of Patent: Aug. 10, 2010

(54) HAIR STYLING DEVICE

(76) Inventor: Kenny Chuong, 1785 Larkspur Ave., Pomona, CA (US) 91767

( * ) Notice: Subject to any disclaimer, the term of this patent is extended or adjusted under 35 U.S.C. 154(b) by 235 days.

(21) Appl. No.: 12/017,159

(22) Filed: Jan. 21, 2008

(65) Prior Publication Data

US 2009/0183382 A1 Jul. 23, 2009

(51) Int. Cl.
*F27D 11/00* (2006.01)

(52) U.S. Cl. ..... 219/385; 219/379; 219/380; 219/384

(58) Field of Classification Search ..... 219/379–385
See application file for complete search history.

(56) References Cited

U.S. PATENT DOCUMENTS 3,258,578 A * 6/1966 Ferris ..... 392/404
3,612,069 A * 10/1971 Waters et al. ..... 132/212
3,645,007 A * 2/1972 Scott ..... 34/60
3,814,111 A * 6/1974 Doyle et al. ..... 132/272
3,947,659 A * 3/1976 Ono ..... 392/404
3,974,840 A * 8/1976 Doyle et al. ..... 132/272
4,114,022 A * 9/1978 Braulke, III ..... 392/383
4,195,416 A 4/1980 Hall
4,256,127 A * 3/1981 Tsujimoto et al. ..... 132/212
4,523,080 A * 6/1985 Bolton ..... 392/385
4,839,106 A * 6/1989 Steiner ..... 261/28
5,241,974 A * 9/1993 Tsai ..... 132/272
5,642,570 A * 7/1997 Lee ..... 34/98
5,761,824 A 6/1998 Moon et al.

* cited by examiner

*Primary Examiner*—Thor S Campbell
(74) *Attorney, Agent, or Firm*—Dale J. Ream

(57) ABSTRACT

A hair styling device includes a hand unit having an air inlet, an outlet, and a blower between the inlet and outlet. The device further includes a storage case having a water reservoir and being configured to receive the hand unit. Tubing connects the water reservoir to the hand unit. A pump is included that selectively connects the water reservoir to the hand unit liquid inlet. A heater is situated between the water reservoir and the hand unit outlet to vaporize the contents of the water reservoir. The hair styling device includes controls in communication with the pump and blower, for actuating the pump and blower, respectively. The device may be used to selectively deliver hot hair, steam, or mist.

16 Claims, 9 Drawing Sheets

HAIR STYLING DEVICE

BACKGROUND OF THE INVENTION

People have very busy schedules that often start early in the morning such that minimizing the amount of time engaged in personal grooming is very desirable. More particularly, it may be difficult for individuals—particularly women—to find sufficient time to style their hair, especially if their hair is routinely kinky or curly when first waking up. Often, straightening one's hair may require the use of a hair dryer or even a steamer. Merely straightening "morning hair" may also be desirable over taking a shower if a person deems it too cold to go out with wet hair.

Various devices, such as blow dryers, steamers, or curling irons have been proposed in the art in order to style a person's hair. Also, a spray bottle for applying a mist of water to one's hair may be helpful for quickly grooming hair. Although assembly effective for their intended purposes, a person may not have enough time to sequentially plug in and utilize each of these devices or may be traveling and unable to transport and utilize each of these devices.

Therefore, it would be desirable to have a device for use in styling one's hair that is compact for storage, easy to transport, and convenient to use. Further, it would be desirable to have a hair styling device that includes a blow dryer, steamer, and a mister. In addition, it would be desirable to have a hair styling device having its own water reservoir and heating coil for creating steam.

SUMMARY OF THE INVENTION

Accordingly, a hair styling device according to the present invention includes a hand unit having an air inlet and a blower between the air inlet and the outlet. The device also includes a storage case having a water reservoir and being configured to receive the hand unit. Tubing connects the water reservoir to the hand unit liquid inlet. The device further includes a pump to selectively provide contents of the water reservoir to the hand unit liquid inlet.

A first channel in the hand unit operatively couples the tubing to at least one mist outlet situated between the blower and the hand unit outlet. A first valve is included in the hand unit to selectively allow the contents of the water reservoir to enter the first channel. A second channel in the hand unit includes at least one steam outlet and is operatively coupled to the tubing. A second valve in the hand unit selectively allows the contents of the water reservoir to enter the second channel.

The hair styling device further includes a heater in the hand unit to vaporize the contents of the second channel. Respective controls are in communication with the pump, first valve, second valve, and blower to selectively actuate these components.

Therefore, it is a general object of this invention to provide a hair styling device that provides a user with a combination hair dryer, steamer, and mist producing device for styling hair.

Another object of this invention is to provide a hair styling device, as aforesaid, that is storable and transportable in a portable carrying case.

Still another object of this invention is to provide a hair styling device, as aforesaid, that includes a water reservoir and a heater for transforming water into steam and including tubing for delivering the steam through a handheld unit.

Yet another object of this invention is to provide a hair styling device, as aforesaid, that includes a water catch drawer for collecting water that may drain from the hand unit when stored in the case.

Another object of this invention is to provide a hair styling device, as aforesaid, having an alarm clock.

Still another object of this invention is to provide a hair styling device, as aforesaid, in which the storage case includes a window for viewing liquid levels in the water reservoir.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A hair styling device 100 according to the present invention will now be described in detail with reference to FIGS. 1*a* through 9*c* of the accompanying drawings. More particularly, according to the current invention, a hair styling device 100 includes a hand unit 110 and a storage case 140.

Figure 1A:
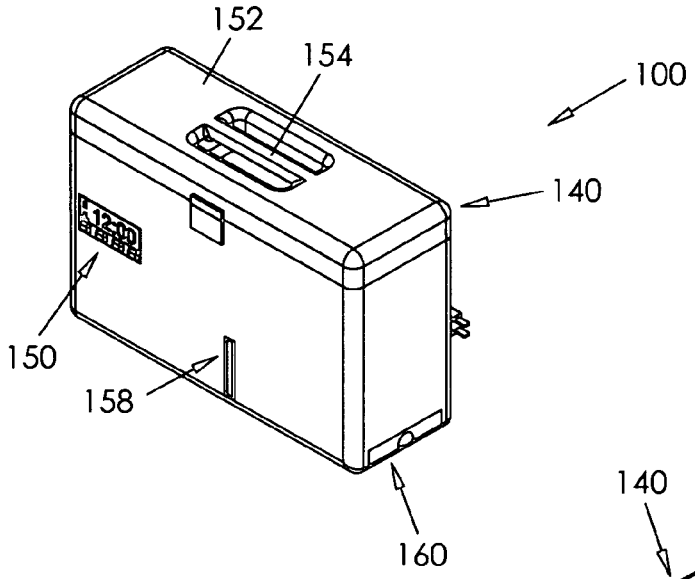
FIG. 1*a* is a perspective view of a hair styling device according to a preferred embodiment of the present invention.
Figure 1B:
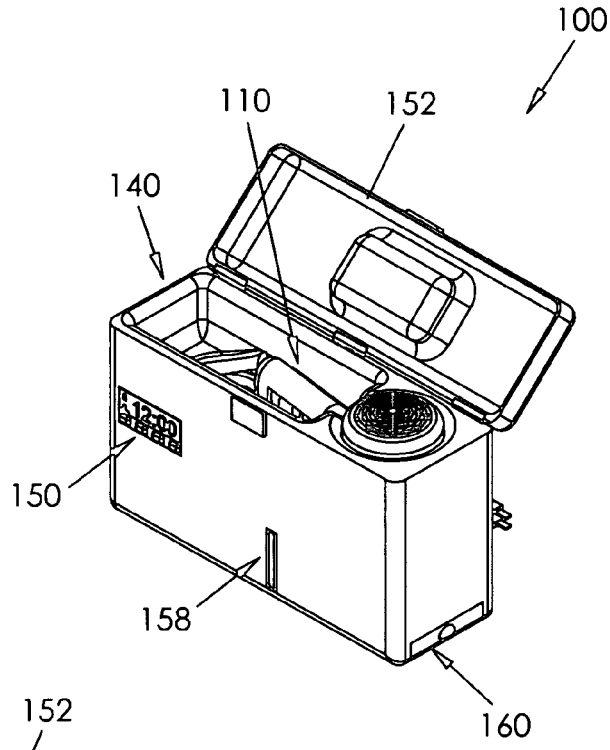
FIG. 1*b* is a perspective view of the hair styling device as in FIG. 1*a* with a lid in an open configuration.
Figure 8A:
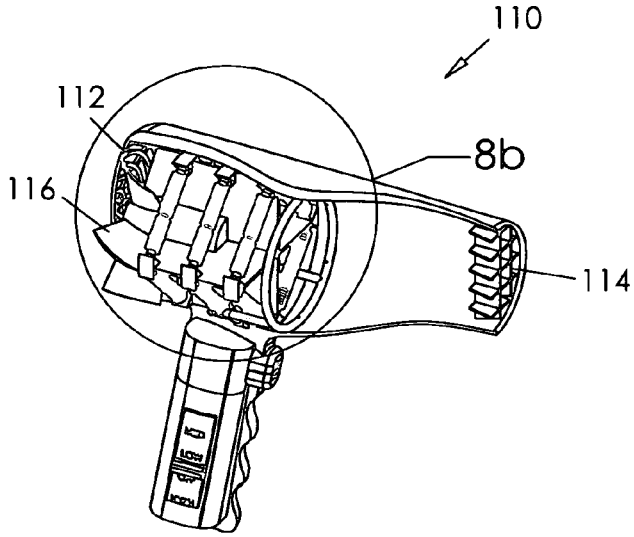
FIG. 8*a* is a fragmentary view of the hand unit as in FIG. 7*a;*
Figure 9A:
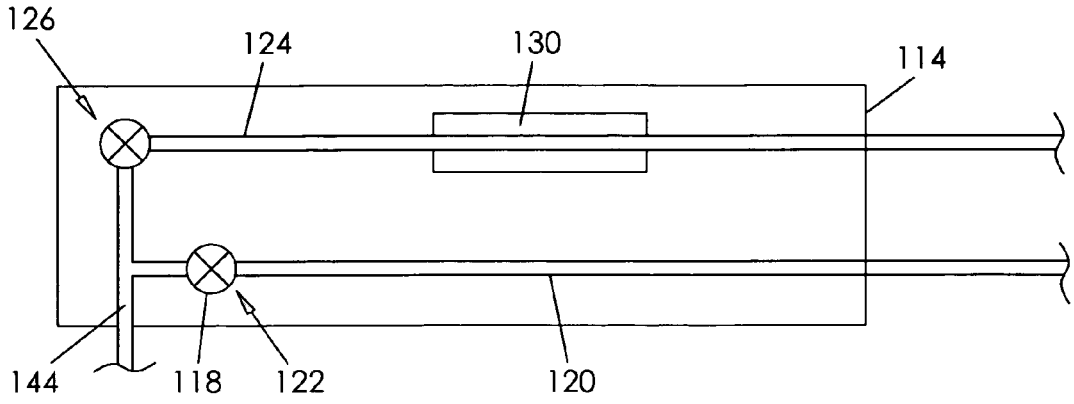
FIGS. 9*a* to 9*c* are schematic diagrams illustrating the water channels and valves situated in the hand unit.
Figure 9B:
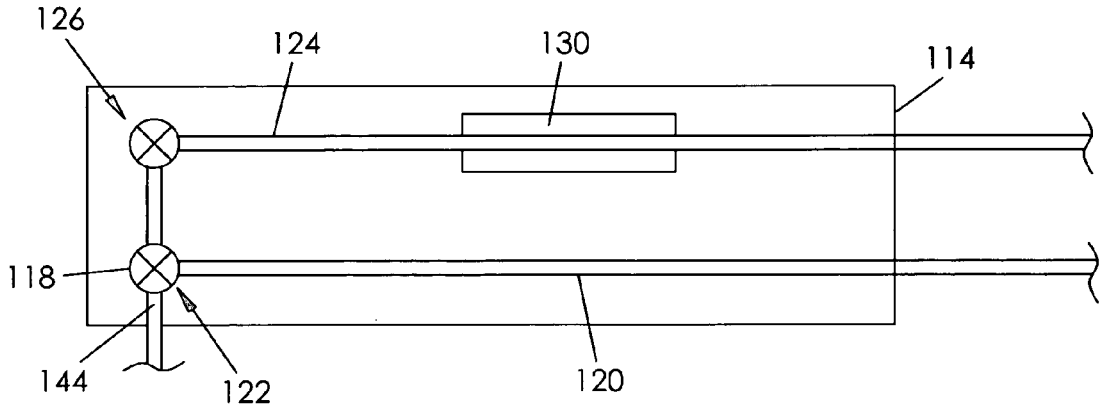
Figure 9C:
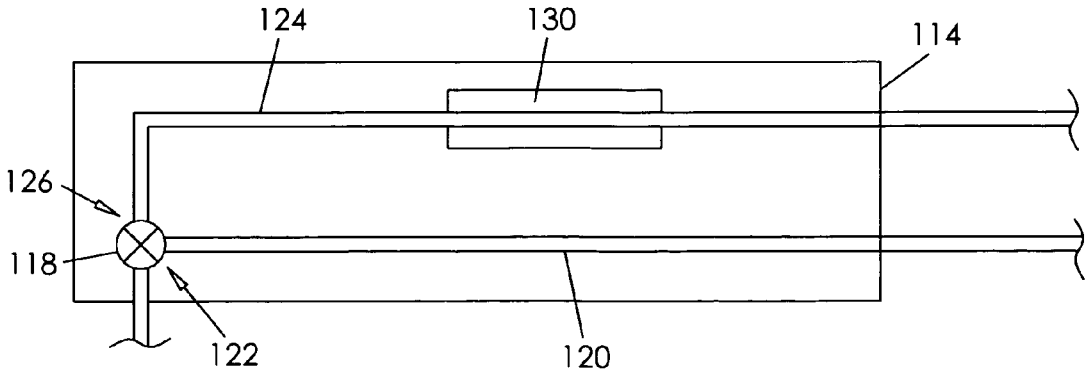

As shown in FIG. 8*a*, the hand unit 110 has an air inlet 112, an outlet 114, and a blower 116 (e.g., a fan) between the air inlet 112 and the outlet 114. The hand unit 110 also has a liquid inlet 118 (FIGS. 9*a* through 9*c*). The storage case 140 has a water reservoir 142 (FIG. 2) and is configured to receive the hand unit 110, as shown in FIG. 1*b*. Tubing 144 (FIG. 2) connects the water reservoir 142 to the hand unit liquid inlet 118, and a pump 146 selectively provides the contents of the water reservoir 142 (e.g., water) to the liquid inlet 118. The pump 146 may preferably be housed in the storage case 140.

Figure 8B:
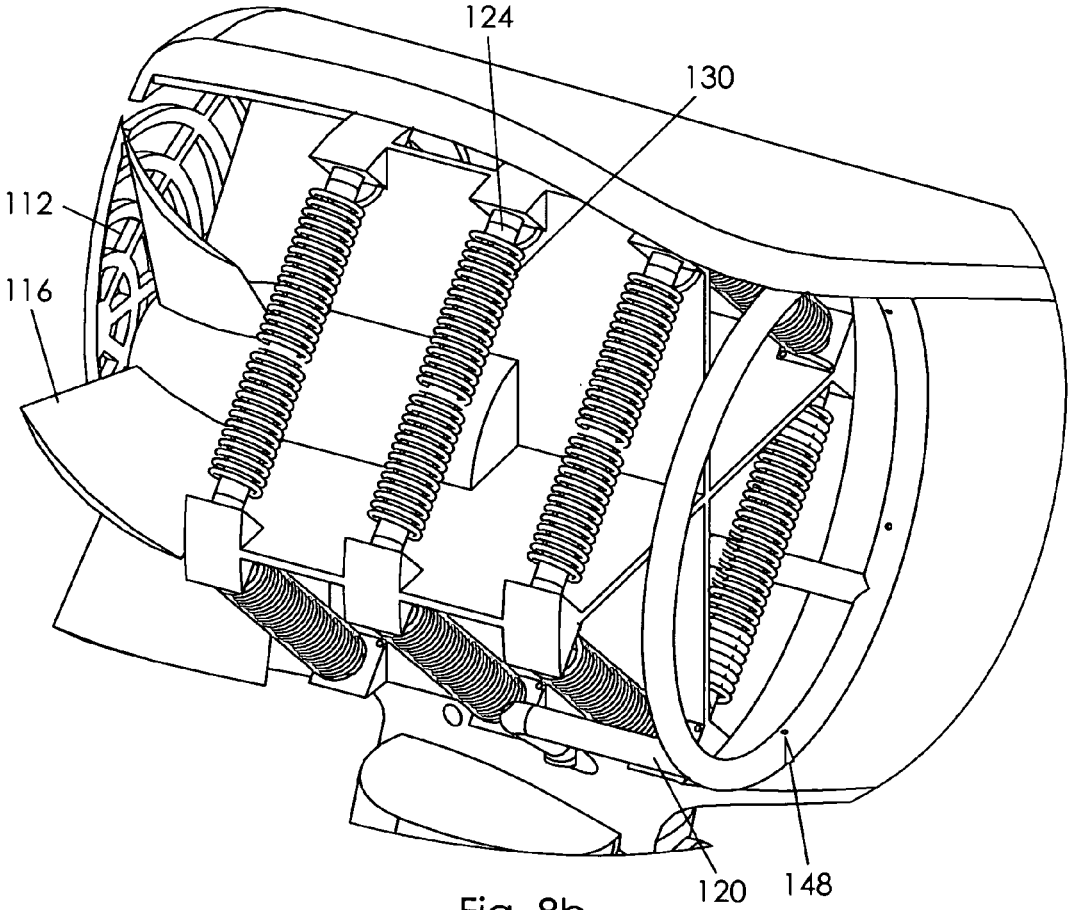
FIG. 8*b* is an isolated view on an enlarged scale taken from a portion of FIG. 8*a*.

Referring again to the hand unit 110, a first channel 120 may be in the hand unit 110 to operatively couple the tubing 144 to at least one mist outlet 148. As shown in FIG. 8*b*, the mist outlet 148 may be positioned between the blower 116 and the hand unit outlet 114. A first valve 122 in the hand unit may selectively allow the contents of the water reservoir 142 to enter the first channel 120. A second channel 124 having at least one steam outlet may be in the hand unit 110, and the second channel 124 may be operatively coupled to the tubing 144. A second valve 126 in the hand unit 110 may selectively allow the contents of the water reservoir 142 to enter the second channel 124. The first and second valves 122, 126 (and channels 120, 124) may be in parallel (FIG. 9*a*) or series (FIG. 9*b*), or the first and second valves 122, 126 may be a single valve (FIG. 9*c*).

A heater 130 (FIGS. 8*b* through 9*c*) may be between the water reservoir 142 and the hand unit outlet 114 to vaporize the contents of the water reservoir 142 exiting the hand unit outlet 114 (i.e., the contents of the second channel 124). As shown in FIG. 8*b*, the heater 130 may be in the hand unit 110 between the air inlet 112 and the hand unit outlet 114 to selectively heat air passing between the air inlet 112 and the hand unit outlet 114. As also shown in FIG. 8*b*, the heater 130 may be an electric resistance coil heater extending around the second channel 124, and the heater 130 and the first channel 120 may be separated so that the contents of the first channel 120 are not vaporized by the heater 130.

Figure 6A:
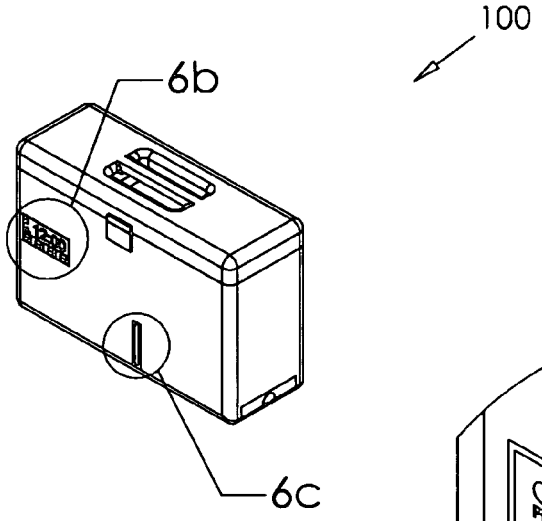
FIG. 6*a* is a perspective view of the hair styling device as in FIG. 4*a;*
Figure 6B:
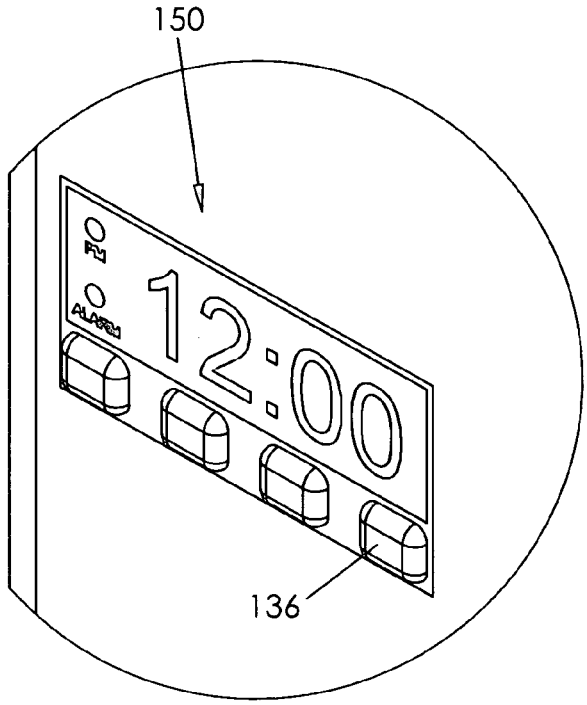
FIG. 6*b* is an isolated view on an enlarged scale taken from a portion of FIG. 6*a;*
Figure 7A:
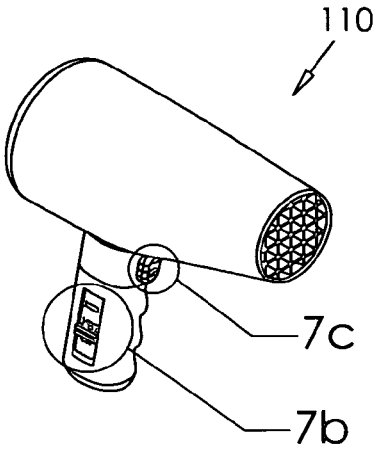
FIG. 7*a* is a perspective view on an enlarged scale of a hand unit removed from the hair styling device as in FIG. 1*c;*
Figure 7B:
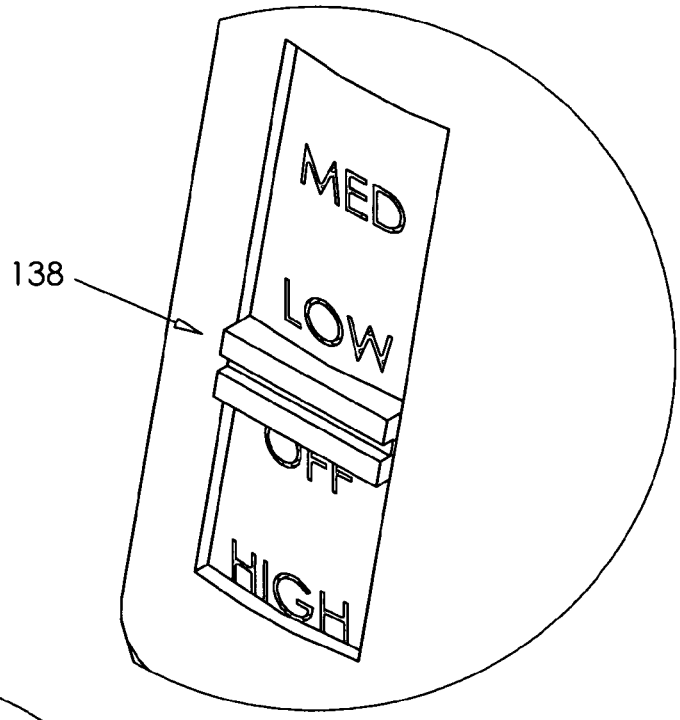
FIG. 7*b* is an isolated view on an enlarged scale taken from a portion of FIG. 7*a;*
Figure 7C:
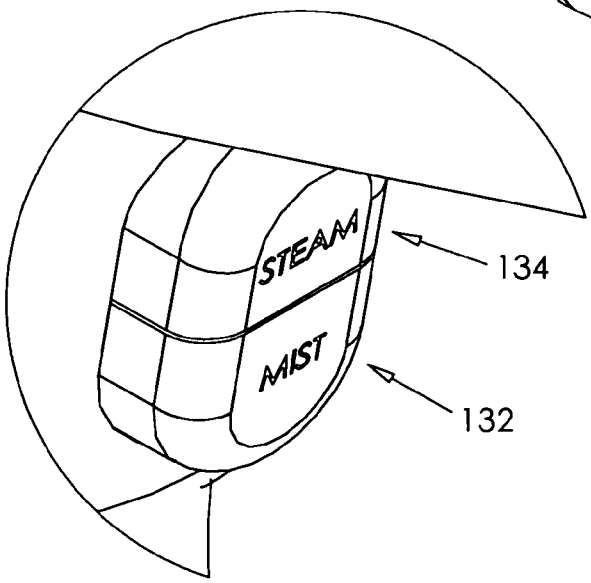
FIG. 7*c* is an isolated view on an enlarged scale taken from another portion of FIG. 7*a;*

As shown in FIG. 7*c*, a control 132 (e.g., a button, switch, etc.) may be in communication with the first valve 122 to selectively actuate the first valve 122, and a control 134 (e.g., a button, switch, etc.) may be in communication with the second valve 126 to selectively actuate the second valve 126. A control 136 may be in communication with the pump 146 to selectively actuate the pump 146. The control 136 may be independent, as shown in FIG. 6*b*, or the control 132 may be tied to the controls 132, 134. As shown in FIG. 7*b*, a control 138 (e.g., a button, switch, etc.) may be in communication with the blower 116 to selectively actuate the blower 116.

Figure 1C:
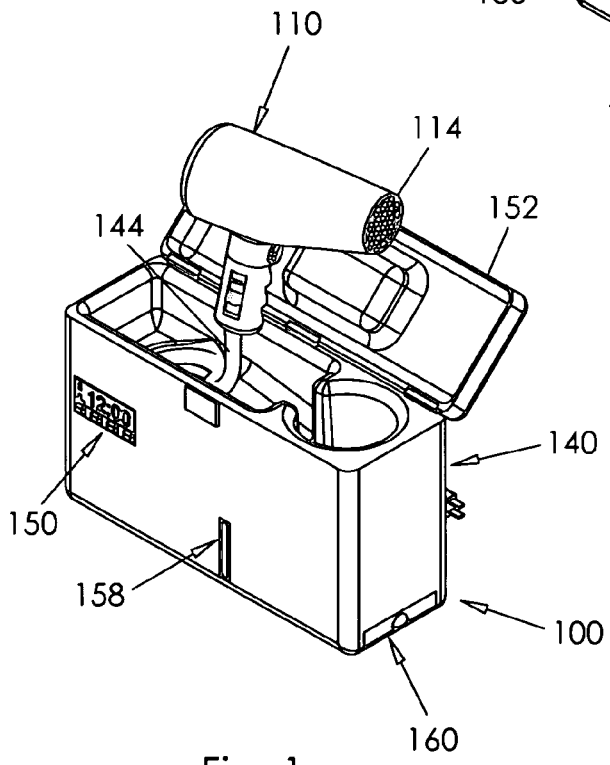
FIG. 1*c* is a perspective view of the hair styling device as in FIG. 1*b* with a hand unit in a partially removed position.
Figure 3A:
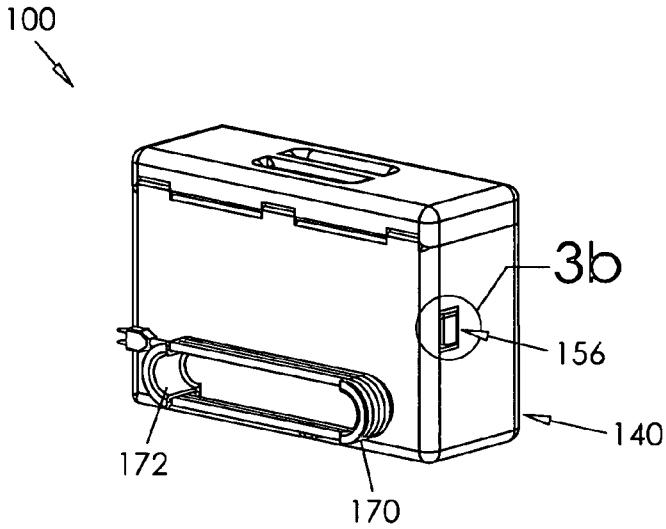
FIG. 3*a* is a perspective view from a reverse angle of the hair styling device as in FIG. 1.
Figure 3B:
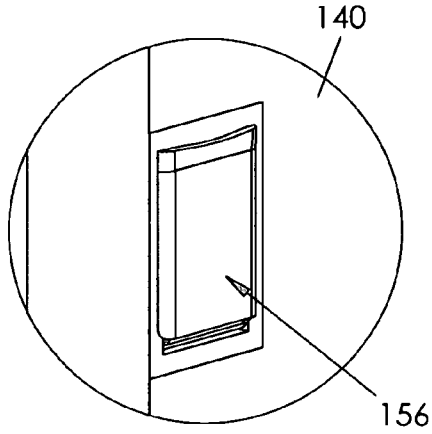
FIG. 3*b* is an isolated view on an enlarged scale taken from a portion of FIG. 3*a;*
Figure 3C:
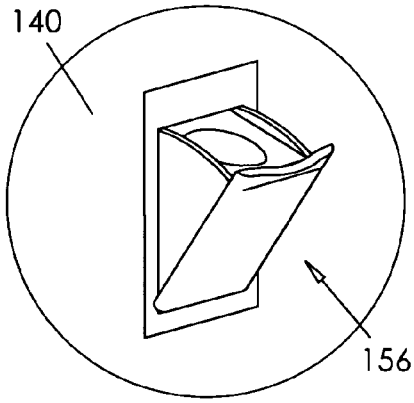
FIG. 3*c* is an isolated view on an enlarged scale taken from another portion of FIG. 3*a;*
Figure 4A:
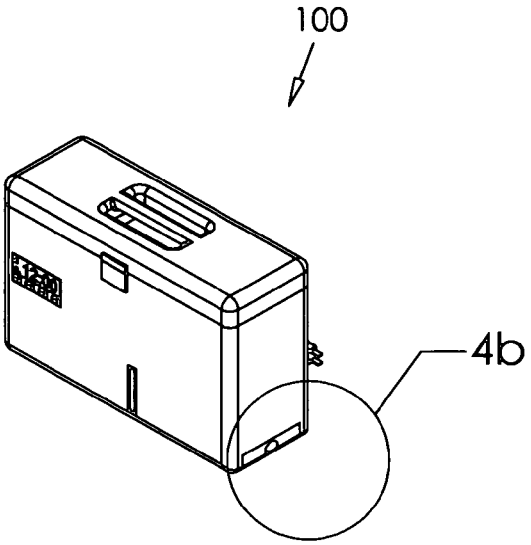
FIG. 4*a* is a perspective view from a another angle of the hair styling device as in FIG. 1.
Figure 4B:
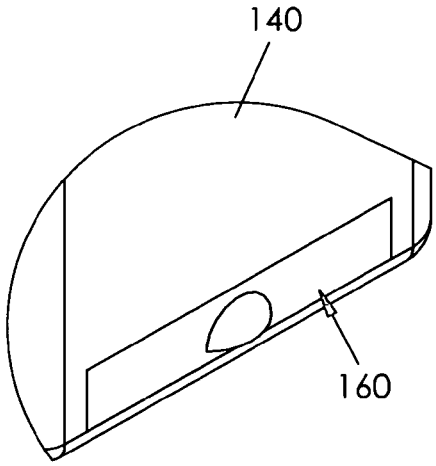
FIG. 4*b* is an isolated view on an enlarged scale taken from a portion of FIG. 4*a*, illustrating a water collection drawer in a closed configuration.
Figure 4C:
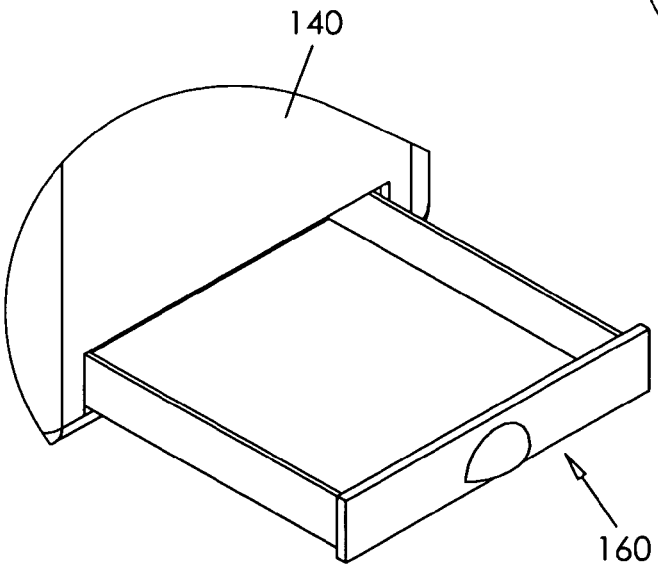
FIG. 4*c* is an isolated view on an enlarged scale taken from a portion of FIG. 4*a*, illustrating a water collection drawer in an open configuration.
Figure 6C:
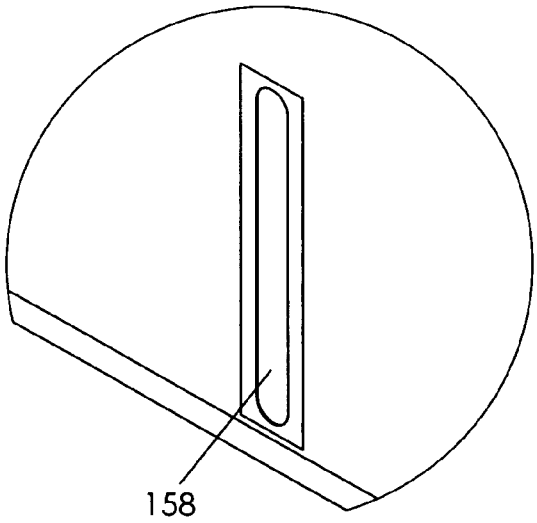
FIG. 6*c* is an isolated view on an enlarged scale taken from another portion of FIG. 6*a;*

Returning to the storage case 140, the storage case 140 may include an alarm clock 150 (FIG. 6*b*) and/or a lid 152 (FIGS. 1*a* and 1*b*) to selectively enclose the hand unit 110 in the storage case 140. As shown in FIG. 1, the lid 152 may include a handle 154 (e.g., a recessed handle as shown, a retractable handle, a protruding handle, etc.), or the storage case 140 may otherwise include a handle for use in transporting the hair styling device 100. The storage case 140 may include a retractable pour nozzle 156 (FIGS. 3*a* through 3*c*) in fluid communication with the water reservoir 142 to introduce water into the water reservoir 142. In one embodiment, as shown in FIG. 6*c*, the storage case 140 includes a window 158 showing the fluid level in the water reservoir 142. A water catch drawer 160 may be included to receive liquid draining from the hand unit 110 when the hand unit 110 is received in the storage case 140. As shown in FIGS. 4*b* and 4*c*, the drawer 160 may be removable from the storage case 140 for emptying.

Figure 2:
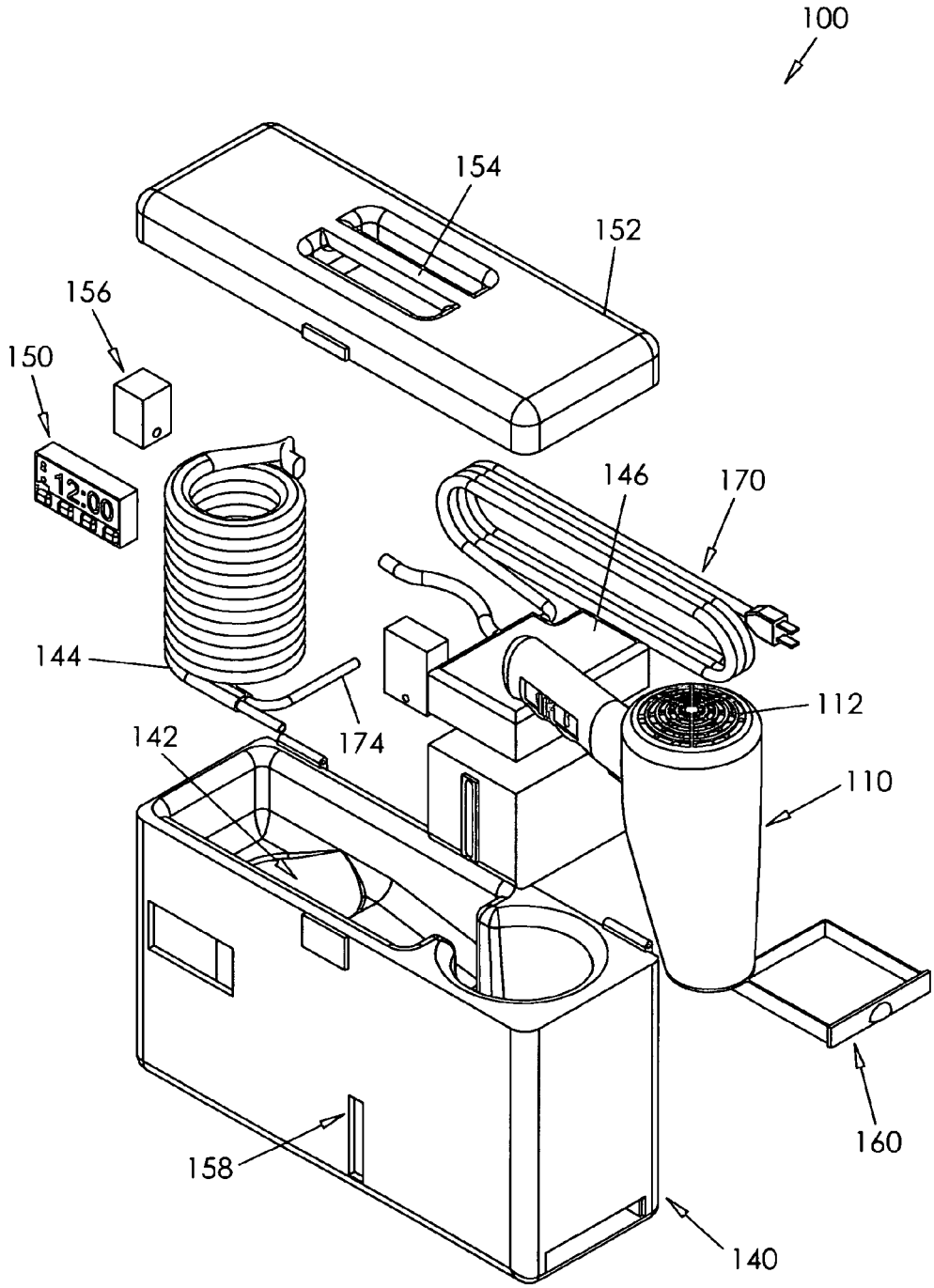
FIG. 2 is an exploded view of the hair styling device as in FIG. 1.
Figure 5A:
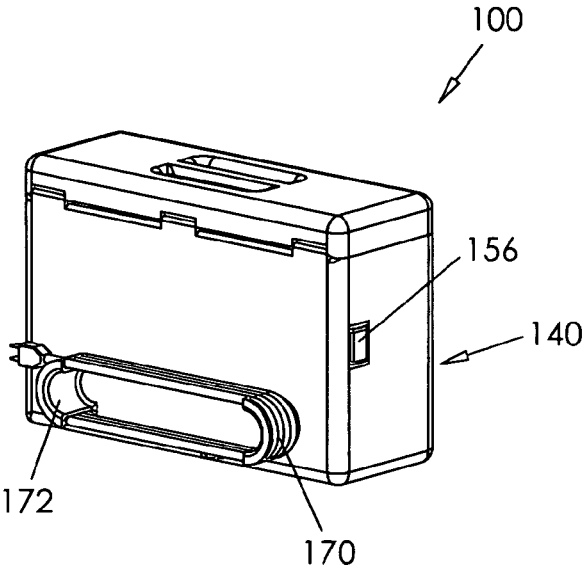
FIG. 5*a* is a perspective view of the hair styling device as in FIG. 3*a*, illustrating one electrical cord assembly.
Figure 5B:
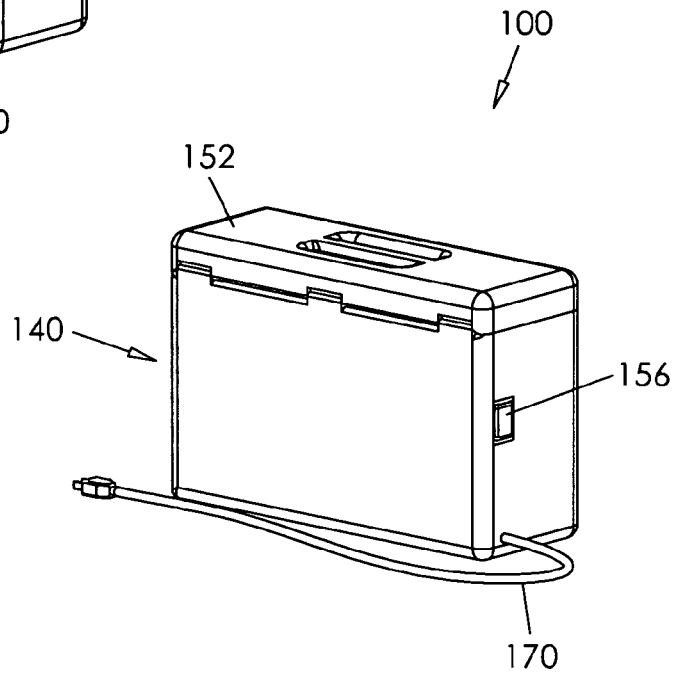
FIG. 5*b* is another perspective view of the hair styling device as in FIG. 3*a*, illustrating another electrical cord assembly.
Figure 5C:
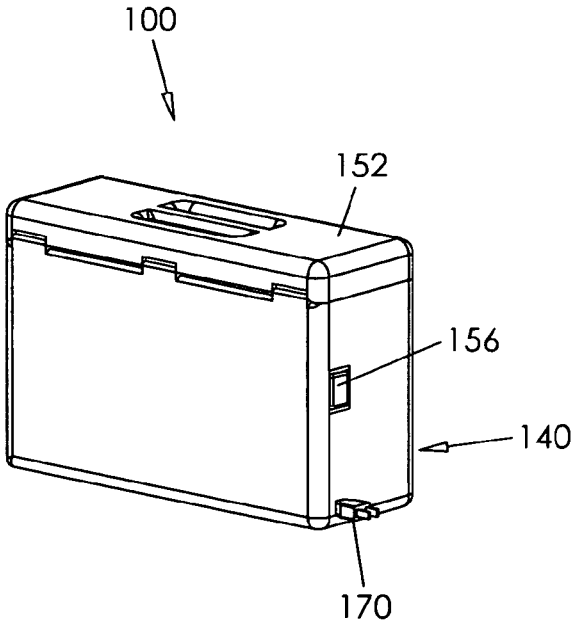
FIG. 5*c* is another perspective view of the hair styling device as in FIG. 3*a*, illustrating still another electrical cord assembly.

As shown in FIG. 2, a first electrical cord 170 may extend from the storage case 140 for interaction with a power source (e.g., a standard one hundred and ten volt power outlet), and the first electrical cord 170 may be in electric communication with the pump 146. The first electrical cord 170 may be retractable (FIGS. 5*b* and 5*c*) or may be manually wrapped about a storage frame 172 (FIG. 5*a*). A second electrical cord 174 (FIG. 2) may extend between the storage case 140 and the hand unit 110 and may be in electric communication with the first electrical cord 170 and the blower 116. As shown in FIG. 2, the second electrical cord 174 may be coupled to the tubing 144. The alarm clock 150 may be electrically powered by a battery or the first electrical cord 170, and the first electrical cord 170 may be replaced or supplemented by a battery.

In use, the hand unit 110 may initially be positioned inside the storage case 140 (FIGS. 1*a* and 1*b*), and the hair styling device 100 may be transported using the handle 154. The alarm clock 150 (FIG. 6*b*) may be used as a morning wake-up alarm, to show the user the current time, and/or as a countdown timer. Water or other appropriate fluid may be placed in the reservoir 142 through the retractable pour nozzle 156 (FIG. 3*c*), and the window 158 may be referenced to determine the amount of water in the reservoir 142 (FIG. 6*c*). The first electrical cord 170 may be plugged into a power outlet.

The hand unit 110 may be removed from the storage case 140 (FIG. 1*c*), and the blower 116 may be activated using the control 138 (FIG. 7*b*) to provide an air stream passing out the hand unit outlet 114. The heater 130 may be activated (e.g., by using a control) to heat the air stream. The user may adjust the valves 122, 126 using the controls 132, 134 (FIG. 7*c*) as set forth above to route water from the reservoir 142 through the first channel 120 to provide a mist through the hand unit outlet 114 or through the second channel 124 to provide steam through the hand unit outlet 114. As noted above, the pump 146 may need to be activated using the control 136, or the pump 146 may be activated by the controls 132, 134. When the user is finished with the hand unit 110, the hand unit 110 may again be positioned inside the storage case 140 (FIG. 1*b*). Any fluid remaining in the hand unit 110 may drain into the water catch drawer 160 (FIG. 4*b*), and the water catch drawer 160 may be removed and emptied as desired (FIG. 4*c*).

It is understood that while certain forms of this invention have been illustrated and described, it is not limited thereto except insofar as such limitations are included in the following claims and allowable functional equivalents thereof.

The invention claimed is:

1. A hair styling device, comprising:

a hand unit having an air inlet, a liquid inlet, an outlet, and a blower between said air inlet and said outlet;

a storage case having a water reservoir and being configured to receive said hand unit;

tubing connecting said water reservoir to said hand unit liquid inlet;

a pump to selectively provide contents of said water reservoir to said hand unit liquid inlet;

a first channel in said hand unit operatively coupling said tubing to at least one mist outlet between said blower and said hand unit outlet;

a first valve in said hand unit to selectively allow said contents of said water reservoir to enter said first channel;

a second channel in said hand unit having at least one steam outlet, said second channel being operatively coupled to said tubing;

a second valve in said hand unit to selectively allow said contents of said water reservoir to enter said second channel;

a heater in said hand unit to vaporize said contents of said second channel;

a control in communication with said pump to selectively actuate said pump;

a control in communication with said first valve to selectively actuate said first valve;

a control in communication with said second valve to selectively actuate said second valve;

a control in communication with said blower to selectively actuate said blower; and wherein said storage case includes a retractable pour nozzle in fluid communication with said water reservoir for introducing water into said water reservoir.

2. The hair styling device of claim 1, wherein said heater is between said air inlet and said hand unit outlet to selectively heat air passing between said air inlet and said hand unit outlet.

3. The hair styling device of claim 2, wherein said heater is an electric resistance coil heater extending around said second channel.

4. The hair styling device of claim 3, wherein said storage case includes:

an alarm clock;

a window showing fluid level in said water reservoir;

a water catch drawer to receive liquid draining from said hand unit when said hand unit is received in said storage case, said drawer being removable from said storage case for emptying;

a retractable pour nozzle in fluid communication with said water reservoir to introduce water into said water reservoir;

a lid to selectively enclose said hand unit in said storage case; and a handle.

5. The hair styling device of claim 1, wherein said storage case includes an alarm clock.

6. The hair styling device of claim 1, wherein said storage case includes a window showing fluid level in said water reservoir.

7. The hair styling device of claim 1, wherein said storage case includes a water catch drawer to receive liquid draining from said hand unit when said hand unit is received in said storage case, said drawer being removable from said storage case for emptying.

8. The hair styling device of claim 1, wherein:

a first electrical cord extends from said storage case for interaction with a power source, said first electrical cord being in electric communication with said pump; and a second electrical cord extends between said storage case and said hand unit, said second electrical cord being in electric communication with said first electrical cord and said blower.

9. The hair styling device of claim 8, wherein:

said first electrical cord is retractable; and said second electrical cord is coupled to said tubing.

10. A hair styling device, comprising:

a hand unit having an air inlet, a liquid inlet, an outlet, and a blower between said air inlet and said outlet;

a storage case having a water reservoir and being configured to receive said hand unit;

tubing connecting said water reservoir to said hand unit liquid inlet;

a pump to selectively provide contents of said water reservoir to said hand unit liquid inlet;

a heater between said water reservoir and said hand unit outlet to vaporize said contents of said water reservoir;

a control in communication with said pump to selectively actuate said pump;

a control in communication with said blower to selectively actuate said blower; and wherein said storage case includes an alarm clock.

11. The hair styling device of claim 10, wherein:

said storage case includes a water catch drawer to receive liquid draining from said hand unit when said hand unit is received in said storage case, said drawer being removable from said storage case for emptying;

said storage case includes a window showing fluid level in said water reservoir;

said storage case includes a retractable pour nozzle in fluid communication with said water reservoir for introducing water into said water reservoir;

a first electrical cord extends from said storage case for interaction with a power source, said first electrical cord being in electric communication with said pump;

a second electrical cord extends between said storage case and said hand unit, said second electrical cord being in electric communication with said first electrical cord and said blower;

said first electrical cord is retractable;

said second electrical cord is coupled to said tubing; and said storage case includes a lid to selectively enclose said hand unit in said storage case.

12. The hair styling device of claim 10, wherein said storage case includes a water catch drawer to receive liquid draining from said hand unit when said hand unit is received in said storage case, said drawer being removable from said storage case for emptying.

13. The hair styling device of claim 10, wherein:

said storage case includes a window showing fluid level in said water reservoir; and said storage case includes a retractable pour nozzle in fluid communication with said water reservoir for introducing water into said water reservoir.

14. The hair styling device of claim 10, wherein:

a first electrical cord extends from said storage case for interaction with a power source, said first electrical cord being in electric communication with said pump;

a second electrical cord extends between said storage case and said hand unit, said second electrical cord being in electric communication with said first electrical cord and said blower;

said first electrical cord is retractable; and said second electrical cord is coupled to said tubing.

15. A hair styling device, comprising:

a hand unit having an air inlet, a liquid inlet, an outlet, and a blower between said air inlet and said outlet;

a storage case having a water reservoir and being configured to receive said hand unit;

tubing connecting said water reservoir to said hand unit liquid inlet;

a pump to selectively provide contents of said water reservoir to said hand unit liquid inlet;

a first channel in said hand unit operatively coupling said tubing to at least one mist outlet between said blower and said hand unit outlet;

a first valve in said hand unit to selectively allow said contents of said water reservoir to enter said first channel;

a heater in said hand unit to heat air passing between said air inlet and said hand unit outlet;

a control in communication with said pump to selectively actuate said pump;

a control in communication with said first valve to selectively actuate said first valve;

a control in communication with said blower to selectively actuate said blower; wherein:

contents of said first channel are not vaporized by said heater;

said storage case includes an alarm clock;

said storage case includes a water catch drawer to receive liquid draining from said hand unit when said hand unit is received in said storage case, said drawer being removable from said storage case for emptying;

said storage case includes a window showing fluid level in said water reservoir;

said storage case includes a retractable pour nozzle in fluid communication with said water reservoir for introducing water into said water reservoir;

a first electrical cord extends from said storage case for interaction with a power source, said first electrical cord being in electric communication with said pump;

a second electrical cord extends between said storage case and said hand unit, said second electrical cord being in electric communication with said first electrical cord and said blower;

said first electrical cord is retractable;

said second electrical cord is coupled to said tubing; and said storage case includes a lid to selectively enclose said hand unit in said storage case.

16. The hair styling device of claim 15, further comprising:

a second channel in said hand unit having at least one steam outlet, said second channel being operatively coupled to said tubing;

a second valve in said hand unit to selectively allow said contents of said water reservoir to enter said second channel;

a control in communication with said second valve to selectively actuate said second valve; and wherein said heater is an electric resistance coil heater extending around said second channel to vaporize contents of said second channel.

* * * * *